United States Patent [19]

Taylor

[11] Patent Number: 4,829,795

[45] Date of Patent: May 16, 1989

[54] ANTI-PRY PADLOCK AND METHOD OF USE

[75] Inventor: Jewell Taylor, Salinas, Calif.

[73] Assignee: Lock-R-Lock, Inc., Salinas, Calif.

[21] Appl. No.: 154,095

[22] Filed: Feb. 9, 1988

[51] Int. Cl.[4] ..... E05B 67/38

[52] U.S. Cl. ..... 70/54; 70/56; 70/38 A

[58] Field of Search ..... 70/54, 55, 56, 417, 70/418, 416, 38 R, 38 A, 38 B, 38 C

[56] References Cited

U.S. PATENT DOCUMENTS

| | | | |
|---|---|---|---|
| 3,453,846 | 7/1969 | Owen | 70/54 |
| 3,475,931 | 11/1969 | Foote | 70/54 |
| 3,713,309 | 1/1973 | Miller | 70/38 A |
| 3,783,657 | 1/1974 | Foote | 70/52 |
| 4,238,941 | 12/1980 | Halopoff | 70/56 |
| 4,548,058 | 10/1985 | Bahry | 70/56 |

FOREIGN PATENT DOCUMENTS

| | | | |
|---|---|---|---|
| 415745 | 11/1946 | Italy | 70/54 |

*Primary Examiner*—Robert L. Wolfe

[57] ABSTRACT

In accordance with the present invention, an anchor assembly is described for use in association with double- and single-keeper padlocks that substantially strengthens such padlocks to withstand prying leverage moments applied at the crown of the shackle. Such padlocks have an upper registry surface through which a shackle disconnectably connects to define locking and unlocking positions.

In accordance with apparatus aspects, the anchor assembly comprises:

(a) first and second reduced side wall notch segments along the lengths of long and short legs of the shackle positioned exterior of the padlock casing, each notch segment being bisected by a normalizing plane through the U-shaped working area of the shackle and including a pair of side wall shoulder surfaces coextensive with other and recessed wall extending therebetween, and (b) a planar base member also exclusively positioned exterior of the padlock casing, having first and second end regions each including coextensive broad surfaces separated by the thickness of the base member.

When the shackle is locked relative to the upper registry, the pairs of side wall shoulder surfaces of the notches are disconnectably connected to the broad surfaces of the base member whereby irrespective of the application direction of prying moments at the crown of the shackle, at least half of each of the pairs is placed in compression thereby the associated pry force works against itself and strengthens the padlock against release.

Method aspects are also described.

26 Claims, 2 Drawing Sheets

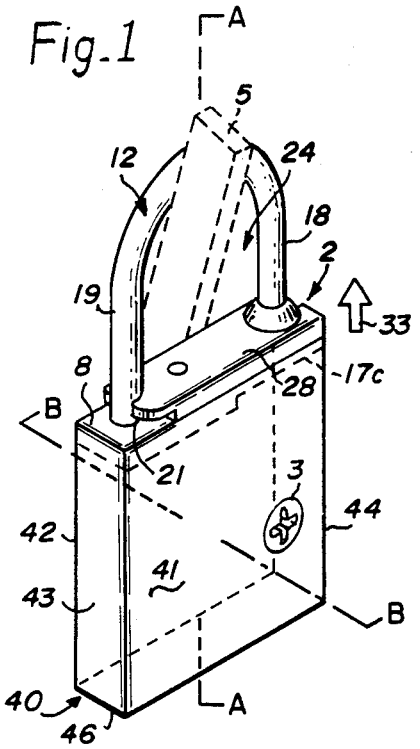
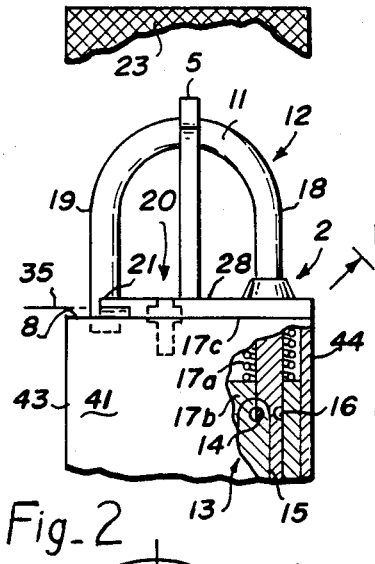
Fig_2
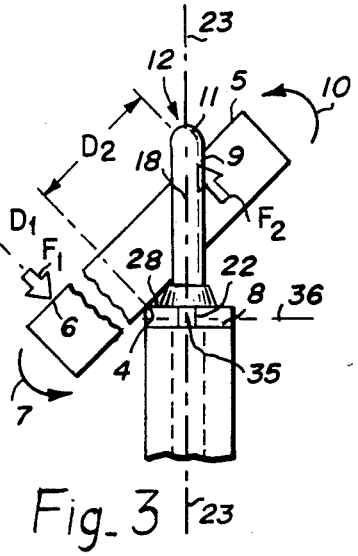
Fig_3
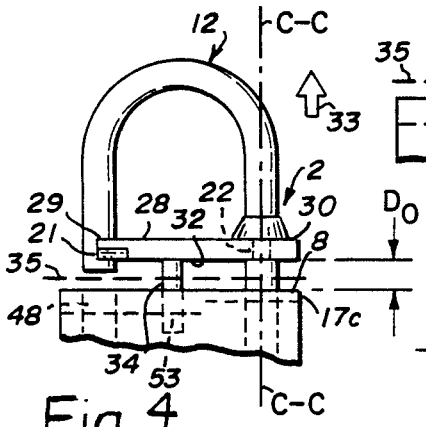
Fig_4
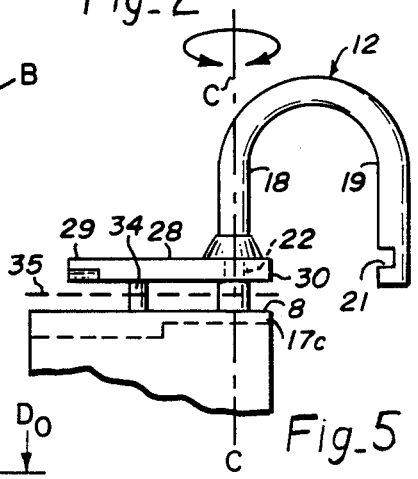
Fig_5
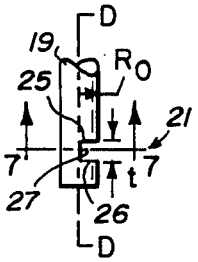
Fig_6
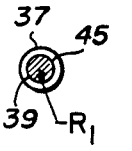
Fig_9
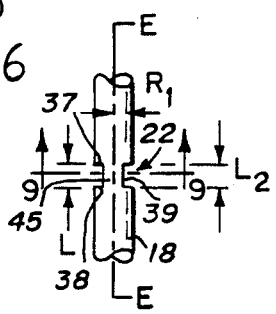
Fig_8
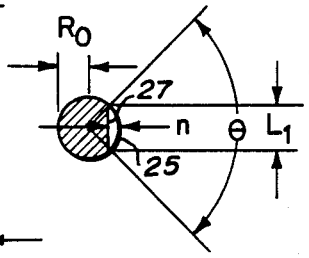
Fig_7
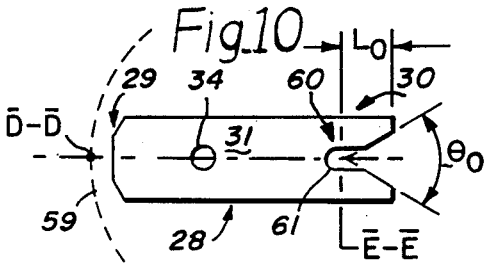
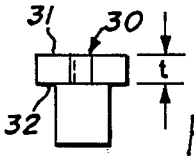
Fig_12
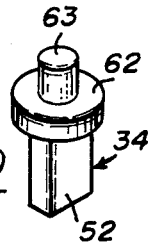
Fig_14
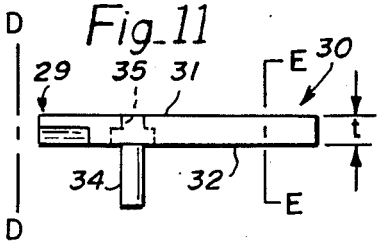
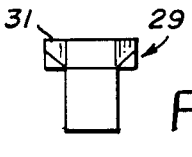
Fig_13

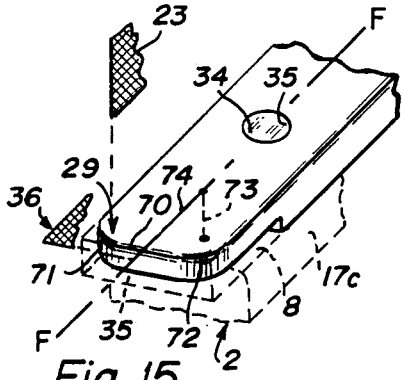
Fig_15
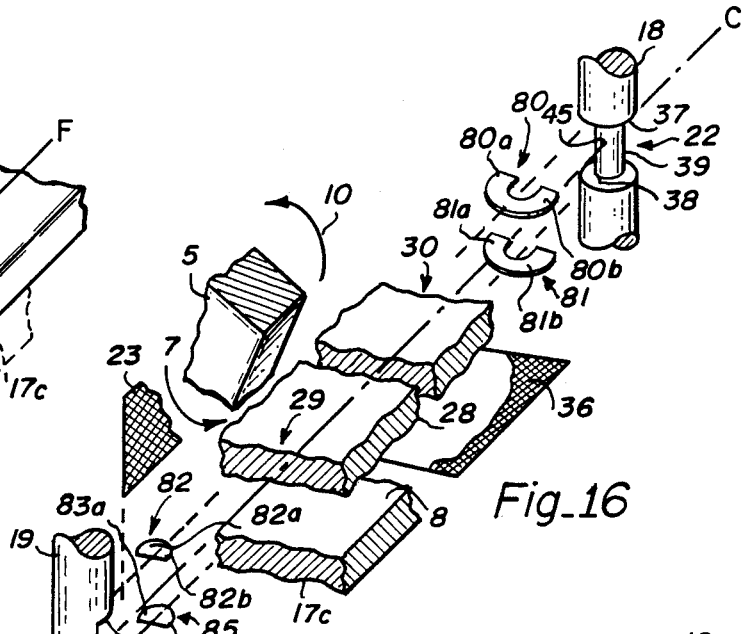
Fig_16
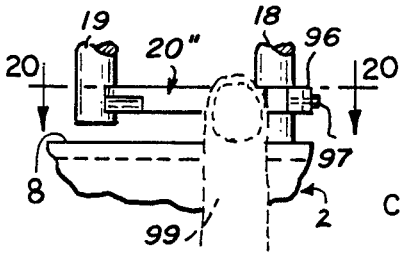
Fig_19
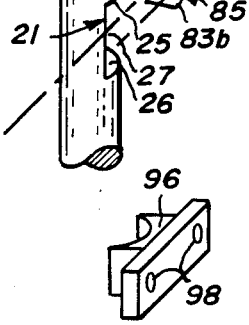
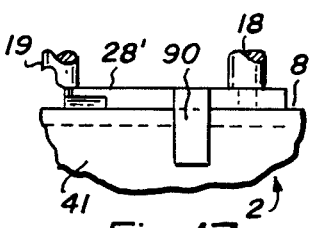
Fig_17
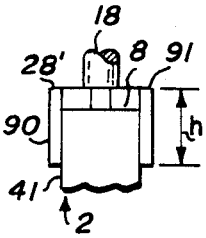
Fig_18
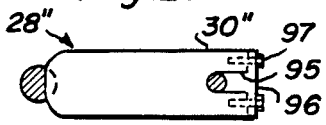
Fig_20
Fig_21
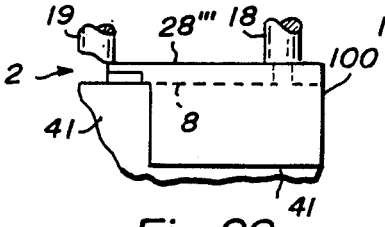
Fig_22
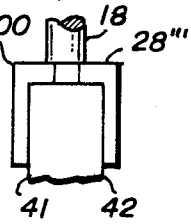
Fig_23
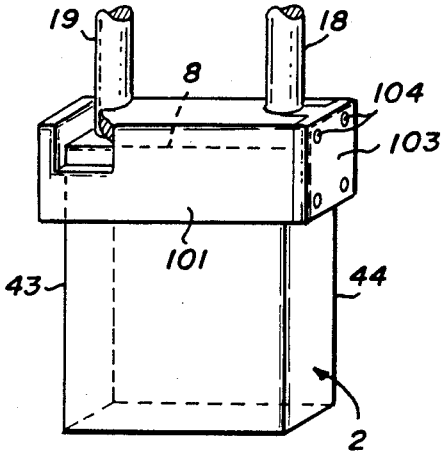
Fig_24
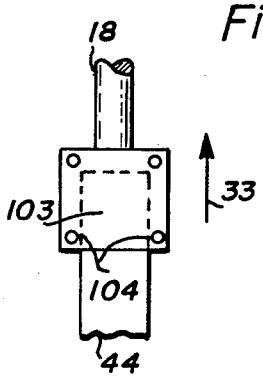
Fig_25
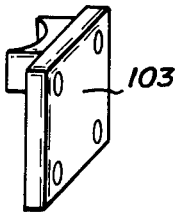
Fig_26

ANTI-PRY PADLOCK AND METHOD OF USE

FIELD

In general present invention relates to shackle-equipped padlocks and more particularly to an anti-pry anchor assembly, such assemblies being in pry-resistant but disconnectable end contact with locked shackle legs of the padlock. As a result, there is an increased capability of the padlock to withstand leverage moments applied at the shackle crown by a pry bar.

DEFINITIONS

In the instant application, the term "leverage moment" refers to the torque generated at the end of a pry bar. It's a function of the force applied to the bar and the distance from the application point to the fulcrum at the edge of the padlock. An equal and opposite moment is generated at the crown of the shackle coextensive of the U-shaped working area and is transformed into a much larger force because the distance from fulcrum to the crown is much less than the distance from the far end of the bar to the fulcrum.

The term "U-shaped working area" means the area bounded by the locked shackle and the distance between the shackle legs. Its exterior of the padlock and has a perimeter equal to the height of the locked legs of the shackle, the arcuate length of the shackle crown and the distance between the shackle legs.

The terms "interior" and "exterior" mean the position of elements of the anchor assembly relative to the perimeter of the padlock casing.

BACKGROUND

Various exterior elements have been proposed to be added to conventional shackle-equipped padlocks to deter burglars and thieves. In the following U.S. patents, shields have been added to conventional shackle-equipped padlocks to obstruct the U-shaped working area after the shackle has been closed and locked, vis. U.S. Pat. No. 3,475,931, D. J. Foote, U.S. Pat. No. 3,453,846, R. L. Owen, U.S. Pat. No. 4,238,941, D. Halopoff.

However, by obstructing the working area, experience has shown that movement of the padlock about a fixed object such as a hasp, is inhibited. Consequently, inserting and removing a key to release the key tumbler can be difficult.

A more recent padlock design of which I am aware (U.S. Ser. No. 22,399 for "PUSH-BUTTON PADLOCK WITH SECONDARY KEY" filed Mar. 16, 1987, assigned to the assignee of the instant application and incorporated herein by reference), uses a different form of tumbler-latching mechanism. The tumbler cylinder is transverse (not parallel) to the shackle socket openings. Also, a single parallel pin is designed to move in synchronism with rotation with the tumbler to clear a single-keeper notch with the longer shackle leg.

While padlocks set forth above have many advantages, there is need to increase their capability to withstand pry forces at the shackle crown without inhibiting padlock operations.

THE INVENTION

SUMMARY

In accordance with the present invention, an anchor assembly is described for use in association with double- and single-keeper padlocks that substantially strengthens them against prying leverage moments applied at the shackle crown. Such padlocks have an upper surface (herein the "registry" surface) through which a shackle passes to define locking and unlocking positions.

In accordance with apparatus aspects, the anchor assembly comprises in operative combination:

(a) a planar base member positioned exterior of the padlock having first and second end regions each including coextensive broad surfaces defining the thickness of the base member; and (b) first and second reduced notch segments along the length of long and short legs of the shackle exclusively positioned exterior of the padlock, each notch segment being bisected by a normalizing plane through the U-shaped working area of the shackle and including a pair of side wall shoulder surfaces coextensive with each other and a recessed wall extending therebetween.

When the shackle is locked relative to the upper registry of the padlock, the pairs of side wall shoulder surfaces are disconnectably connected to the broad surfaces of the base member. Each of such pairs is bisected by the normalizing plane of the U-shaped working area whereby irrespective of the application direction of prying moments at the crown of the shackle, at least half of each of the pairs is placed in compression. Since the force due to prying movement then works against itself, the padlock is substantially strengthened against premature release. However, during normal release of the shackle using a keyed-tumbler, the base member can be carried in tandem with initial, spring-driven movement of the shackle away from contact with the upper registry, but remains coextensive thereof as the shackle is pivoted about its longer leg.

In one embodiment of the invention, the base member is provided with a guide pin that extends into the interior of the casing through an opening in the upper registry. In that way, the base member is prevented from following the shackle in pivotal movement. In another embodiment, but for the same purpose, the base member is provided with a pair of guide fingers (herein "struts") in slidable contact with opposed broad exterior surfaces of the casing. The length of the struts relative to the total initial rectilinear movement is such that as the shackle pivots, the base member remains coextensive of the upper registry. In yet another embodiment, the guide struts extend along front and back surfaces to form a partial skirt. In still yet another embodiment, the partial skirt is extended about the end walls of the casing to provide full perimeter skirt. In the last two mentioned embodiments, such skirts not only prevent rotation of the base member, but also prevent insertion of a thin pry bar between the base member and the upper registry of the padlock.

In accordance with method aspects, a double- or single-keeper padlock can be strengthened against leverage moments applied to the crown of the shackle irrespective of the application direction, by the steps of:

(a) establishing at the intersection of a normalizing plane coextensive of the U-shaped working area and a second plane parallel to the upper registry but transverse to the normalizing plane, first and second reduced side wall notch segments along said long and short legs, each segment including a pair of extending side wall shoulder surfaces and a recessed wall extending therebetween, (b) placing a base member at the intersection of the normalizing and transverse planes, in disconnectable end contact with the notch segments, (c) dividing any leverage moments applied at the crown of the shackle about the normalizing plane into the pairs of side wall shoulder surfaces whereby irrespective of the direction of such leverage moments, at least half of each pair is placed in compression. Since the pry force works against itself, the padlock is substantially strengthened against premature release.

Further features of the invention will become more apparent upon consideration of the following detailed descriptions of preferred embodiments when taken in connection with the accompanying drawings.

BRIEF DESCRIPTION OF THE DRAWINGS

FIG. 1 is a perspective view of an anti-pry anchor assembly pry-resistant disconnectable contact with a padlock in the locked position;

FIG 2 is a front elevation of the shackle-equipped padlock and anti-pry anchor assembly of FIG. 1—partially cut away-illustrating how prying forces of a pry bar can be withstood in irrespective of the fact that the shackle-equipped padlock only includes a single keeper looking arrangement associated with the longer shackle leg;

FIG. 3 is a side elevational view of the anti-pry anchor assembly and shackle-equipped padlock of FIG. 2 illustrating how torques generated by the pry bar of FIG. 13 can be calculated;

FIG. 4 is a front elevation of the upper portion of the padlock of FIG. 1 wherein the anti-pry anchor assembly of the present invention has undergone vertical movement following release of the shackle relative to the padlock casing;

FIG. 5 is yet another front elevation of the padlock in FIG. 1 wherein the shackle has undergone pivotal movement about the longer shackle leg but wherein the anti-pry anchor remains coextensive with the upper surface of the padlock casing;

FIGS. 6–9 are details of the shackle of the anchor assembly of FIGS. 1–5 wherein FIGS. 7 and 9 are sections taken along lines 7—7 and 9—9 of FIGS. 6 and 8, respectively;

FIGS. 10–15 are details of a base member of the anti-pry anchor assembly of FIGS. 1–5;

FIG. 16 is a greatly enlarged perspective view of the shape of the contact areas during locking such areas being located between the regions of the base member of the anti-pry anchor assembly of FIGS. 1–5 relative to pairs of shoulder surfaces of notch segments formed in the shackle legs;

FIGS. 17 and 18 are front and side elevation views, respectively, of a modified anti-pry anchor assembly having a pair of guide struts in pry-resistant but slidable contact with the padlock casing;

FIGS. 19–21 illustrate yet another modification of the invention, wherein FIG. is a front elevation of the anti-pry anchor assembly of the invention; FIG. 20 is a section taken along line 20–20 of FIG. 19; and FIG. 21 a perspective detail of a releasable wedge attachable between the longer shackle leg and the modified anchor assembly;

FIGS. 22–26 illustrate further modifications associated with the anti-pry anchor assembly of the present invention; FIGS. 22 and 23 being front elevational and side elevational views, respectively, of another modified anchor assembly having a partial skirt coextensive with the front and rear walls for guiding the anchor in vertical movement relative to the padlock casing; FIGS. 24 and 25 being front perspective and side views, respectively, if yet another modified anchor of the invention having a full skirt about the full perimeter of the casing; and FIG. 26 being a perspective detail of an end plate of the anchor assembly of FIGS. 24 and 25.

DETAILED DESCRIPTION OF BEST MODE

The following detailed description illustrates the present invention by way of example only and not by way of limitation of the principles thereof. This description will clearly enable one skilled in the are to make and use the invention and describes several embodiments, adaptations, variations, alternatives and uses of the invention, as well as its operating principles, including what is presently believed to be the best mode for carrying out the invention.

Referring to FIG. 1, there is shown in accordance with the present invention, a shackle-equipped padlock 2 having vertical and horizontal axes of symmetry A—A and B—B, respectively. The padlock 2 includes an internal keeper mechanism that includes keyed tumbler 3 of circular cross section operating in either single- or double-keeping mode. The particular internal lock tumbler is not part of the invention and may be of any type, key, pad button, rotary dial(s) or the like. For purposes of discussion, it is assumed for simplicity that the keyed tumbler 3 of FIG. 1 is an element of a single-keeper locking mechanism. While such single-keeper mechanisms have many advantages, there is a need to increase their capability to withstand pry forces such as can be generated by a pry bar 5 shown in phantom line without inhibiting internal and external padlock operations.

FIGS. 2 and 3 illustrate operation of pry bar 5 in more detail.

As shown in FIG. 3, pry bar 5 is placed on a diagonal across the padlock 2 and makes contact (i) with corner 4 adjacent to upper registry 8 and (ii) at arcuate crown 11 of shackle 12. Assume a force F1 is applied to bar 5 at application point 6. Since a fulcrum is established at corner 4, force F1 is separated from the fulcrum by distance D1. Thus, a resulting leverage moment is generated equal to $F1 \times D1$ and acts in the direction of arrow 7.

Simultaneously, there is generated an equal and opposite leverage moment at the intersection of bar 5 with the crown 11 of the shackle 12, viz., at application point 9 acting the direction of arrow 10. Note that the application point 9 is separated by a distance D2 from corner 4. Thus, by analysis, although the leverage moment at the ends of the pry bar 5 are equal and opposite, there are unequal distances between their points of application 6, 9, and the corner 4. That is to say, the distance D2 is much less than distance D1. Hence, a greater force F2 is established at the application point 9 of the crown 11. And when only a single keeper mechanism is used as shown generally at 13, the force F2 can be great enough to prematurely release the shackle 12. That is, rotatable pin 14 of the single-keeper mechanism 13 normally controlled by crank arm 15 (connected in turn to the keyed tumbler 3 of FIG. 1), can be prematurely released from notch 16 of longer leg 18 of shackle 12. Release movement is resisted by anchor assembly 20 of the present invention in the manner set forth below.

Before describing the anchor assembly 20 in detail, an overview is in order and is presented below.

Briefly, in accordance with the present invention, hardened anchor assembly 20 is used in association with padlock 2 containing either an internal single- or double-keeper locking mechanism. Such padlocks 2 have an upper registry surface 8 through which the hardened shackle 12 disconnectably connects relative to top wall 17*c* to define locking and unlocking positions.

In accordance with apparatus aspects, the anchor assembly 20 substantially strengthens such padlocks against prying moments such as applied to the crown 11 in the manner set forth above and comprises:

(a) first and second side wall notch segments 21, 22 (FIGS. 2 and 3) ar along each of the lengths of long and short legs 18, 19 of the shackle 12 exclusively positioned exterior of registry surface 8 of the padlock 2, each notch segment 21, 22 being coextensive with a portion of normalizing plane 23 (FIGS. 2 and 3) through a U-shaped working area 24 (FIG. 1) and including a (i) pair of side wall shoulder surfaces 25, 26, 37, 38 (FIGS. 6–9) coextensive with each other and (ii) recessed wall 27, 39 extending therebetween, (b) a case hardened planar base member 28 also exclusively positioned exterior of registry 8 having first and second end regions 29, 30 (FIGS. 10–15), each including coextensive broad surfaces 31, 32 separated by the thickness (t) of the base member 28.

When the shackle 12 is locked relative to the upper registry 8, the two pairs of shoulder surfaces 25, 26, and 37, 38 engage the broad surfaces 31, 32 of the base member 28 wherein each of such pairs 25, 26, and 37, and 38 is bisected by the normalizing plane 23 associated with the U-shaped working area 24 so that irrespective of the application direction of prying moments at the crown 11 of the shackle 12, at least half of each of the pairs 25, 26, 37, 38 are placed in compression. Since the force due to the prying movements thus works against itself, the padlock 2 is strengthened against premature release.

The term "U-shaped working area" means the area bounded by the locked shackle 12 and upper surface 31 of base member 28. It is exterior of the padlock and has a perimeter equal to the height of the locked legs 18, 19; the arcuate length of the shackle crown 11; and the distance between the locked legs 18, 19.

However, during normal release of the shackle 12 using keyed-tumbler 3 as shown in FIG. 1, the base member 28 can be carried along with initial spring-driven rectilinear movement of the shackle 12 away from contact with the registry 8 in the direction of arrow 33 but remains coextensive with the upper registry 8 as the shackle 12 undergoes pivoting about long leg 18.

In one embodiment of the invention, the base member 28 is provided with a guide pin 34 (FIGS. 10 and 11) that extend into the interior of the padlock through an opening. When so positioned, the pin 34 prevents the base member 28 from following the shackle 12 in pivotal movement relative to registry 8.

Further features of the invention will become more apparent upon consideration of the following detailed descriptions of preferred embodiments as set forth in detail below.

In FIGS. 1–3, intersection 35 is defined a line in space associated with normalizing plane 23 and transverse plane 36 (FIG. 3) when the shackle 12 is in locking position relative to the top wall 17*c*. The intersection line 35 bisects notch segments 21, 22 in the shackle legs 18 and 19. Hence, not only is line 35 coincident with the axis of symmetry of base member 28, it also passes through notch segments 21, 22. The line 35 and plane 36 are exterior of the padlock. Also, in the locked position, lower surface 32 and the base member 28 are in surface contact with the exterior registry surface 8.

The terms "interior" and "exterior" relate to the position of elements of the anchor assembly 20 including base member 28 relative to the perimeter established by casing 40 as defined by front and rear walls 41, 42; side walls 43, 44; and top and bottom walls 17*c*, 46; respectively. Although the casing 40 is of rectangular cross section wherein the length of the front and rear walls 41, 42 is much greater than that of side walls 43, 44, say by 3:1, the same classifications would apply to other padlock shapes including square and symmetrical locks.

Referring now to FIG. 4, lower surface 32 of the base member 28 is seen to be above registry 8 after release has occurred. Note that since end regions 29, 30 of base member 28 remain engaged in notch segments 21, 22 of the shackle legs, they follow the initial rectilinear movement of the shackle 12 in the direction of arrow 33.

Since the short leg 19 has escaped from socket opening 48, the release distance Do, above upper registry 8, (due to spring force) is as shown in FIG. 4. Since the shackle legs also include notch segments 21, 22 in contact with end regions 29, 30, upward movement of the shackle 12 carries the base member 28 into similar movement. Such movement is aided by guide pin 34 attached to base member 28, and slidably engaged within opening 53 in top wall 17*c*.

However, opening 53 and the length of the guide pin 34, combine to prevent the base member 28 from following shackle 12 in pivotal movement around axis C—C of longer leg 18 as shown in FIG. 5.

As shown, the base member 28 and guide pin 34 remain stationary and aligned with registry surface 8 during and after pivotal movement of the shackle 12. But notch segment 21 is no longer in contact with the end region 29 of the base member 28. On the other hand, the opposite end region 30 remains in operative contact with notch segment 22.

FIGS. 6–9 illustrate the shackle 12 in detail while FIGS. 10–15 illustrate details of base member 28. FIG. 16 illustrates the contact areas of the locked shackle 12 and the base member 28.

As shown in FIGS. 6–9, shackle 12 includes notch segments 21, 22 associated with legs 18, 19, respectively. Each segment 21, 22 will now be described in sequence.

Notch segment 21 associated with short leg 19 is seen in FIGS. 6 and 7 to be non-symmetrical with respect of axis of symmetry D—D. That is to say, even though leg 19 is circular in cross section defined by normal radius Ro, recessed wall 27 of notch segment 21 with respect to axis of symmetry D—D is offset therefrom. Thus, in FIG. 7, the wall 27 defines a series of equi-length chords of a set of transverse cross sections along the vertical length of the wall 27 about equal to the thickness (t) of the base member 28.

GEOMETRICAL RELATIONSHIPS

While the notch segments 21, 22 have been previously described in some detail, geometrical principles can also be employed for the same purpose along the lines set forth below. These principles are well-known, being easily recognized by the average artisan to which the present invention is directed.

For example, with respect to notch segment 21, note that length $L_1$ of wall 27 is mathematically related to radius Ro, and central angle $\theta$ (FIG. 7) in accordance with $$L1 = 2\ Ro \sin \theta/2$$

Also, the pair of shoulder surfaces 25, 26 transverse to recessed wall 27, is each defined by an arc S subtended by a central angle $\theta$ (FIG. 7) that is related to the radius Ro in accordance with $$S = Ro\theta$$

Since the rise distance h is related to the radius Ro and the central angle $\theta$ in accordance with $$h = Ro - Ro \cos \theta/2$$

The area of each arcuate shoulder surfaces 25, 26 is equal to $$Ro^2 \cos^{-1} (Ro - h)/Ro - (Ro - h) \sqrt{2Roh - h^2}$$

where

Ro is the radius of the leg 19 and h is the rise distance of the shoulder surfaces 25, 26.

Furthermore, with reference to FIGS. 8 and 9, notch segment 22 associated with longer leg 18 is seen to be symmetrical with respect to axis of symmetry E—E; hub 45 is abruptly reduced to define vertical wall 39 of reduced diameter terminating in the pair of shoulder surfaces 37, 38. The length (L2) of the reduced hub 45 defines the total length of the wall 39 and is equal to the thickness (t) of the base member 28. Inasmuch as the thickness of the base member 28 does not vary, then the lengths of the notch segments 21, 22 are equal $$L1 = L2 = \text{thickness of the member } 28$$

Since the should surfaces 37, 38 are annular, each individual area is equal to $$A1 = \pi Ro^2 - R_1^2$$

where Ro is the radius of the leg 18 and Ri is radius of the hub. But the base member 28 of FIG. 10 includes slot 60 which diminishes the relative contact area with respect to the shoulder surfaces 37, 38 by a factor related to the radius R1 of the hub 45, the length Lo of the slot 60 and angle $\theta$ (FIG. 10) subtended by the intersection of a normal to the circumferencial edge of the leg 18 in accordance with $$\pi Ro2 - [\pi/4\ R_1^2 + R1Lo + Ro^2 \cos^{-1} Ro - (Ro - h/Ro) - (Ro - h) \sqrt{2Roh - h^2}]$$

where

Ro is the radius of leg 18;

R1 is the radius of hub 45;

Lo is the longitudinal length of slot 60 measured from a is E—E to the normal of the inter-sectum of the leg 18 and the slot 60; and $\theta$o is the central angle at center of radius Ro and R1 that subtends the normal through the circumferential edge of leg 18; and h is the rise distance of the subtended sector at angle $\theta$o.

Note that the radius R1 of the hub 45 and length Lo of the slot 60 must be small enough that the resulting area provides sufficient area in contact with end region 30 to withstand prying forces as explained below.

BASE MEMBER 21

FIGS. 10–15 describe base member 28 in more detail. Before such description begins, note that the shape and function of end regions 29, 30 are directly related their interaction with notch segments 21, 22. Hence, the latter are indicated in FIGS. 10 and 11 in both locked and unlocked positions through the depiction of their axis of symmetries D—D and E—E.

As shown in FIGS. 10 and 11, base member 28 comprises first and second end regions 29, 30 each including coextensive upper and lower broad surfaces 31, 32 separated by the thickness. When the padlock is locked, the notch segments (not shown but indicated by axes D—D and E—E), engage the broad surfaces 31, 32 of the base member 28 wherein the padlock is strengthened against release. However, during the normal release of the padlock, the base member 28 can be carried in tandem with initial rectilinear movement of the shackle 12 but remains coextensive with the upper registry as the short leg 19 undergoes arcuate movement along pathway 59 (FIG. 10). Note that during such movements, the axis of symmetry D—D and E—E remain transverse to the intersection 35.

Now in more detail in FIG. 10, note that the slot 60 also includes a side wall 61 having a line of formation coincident with axis E—E. Since preferably the line of formation defines a C radius equal to R1 of the hub 45, there is surface-to-surface contact at the intersection of end region 30 and wall 39 during both locking and unlocking operations of the padlock.

However, as shown in FIG. 15, the end region 29 is of more complex construction in order to accommodate conventional unlocking of the shackle 12.

As shown, the end region 29 includes an end wall 70 flanked by arcuate end sections 71, 72. Each section 77, 72 has two separate lines of formation, one being located along vertical line 73 coincident with plane 23, and the other being located along horizontal line 74 coincident with axis of symmetry F—F. In that way, the end region 29 can be released from contact with the short leg 19 even though the latter is being spring-biased in one direction and undergoing pivoting movement in another.

Remote from the end wall 70 is a central region that is seen to include opening 35 for receiving guide pin 34 as previously explained. Since pin 34 is preferably revised relative to opening 35, the pin 34 includes an annular rivet button 62 (FIG. 14) between a head 63 and cantilevered end region 52.

METHOD ASPECTS

In accordance with method aspects, a double or single-keeper padlock can be strengthened against a leverage moment applied to the crown 11 of the shackle 12 (FIGS. 1–3) irrespective of application direction, by the steps of:

(a) establishing at intersection line 35 (FIG. 15) of a normalizing plane 23 and a second plane 36 transverse to normalizing plane 23 adjacent to upper registry 8 (FIGS. 2,3, and 16) first and second reduced notch segments 21, 22 in long and short legs 18, 19 (FIGS.

6–9), each segment 21, 22 including a pair of extending side wall shoulder surfaces 25, 26, and 37, 38 and a recessed wall 27, 39 extending therebetween (FIGS. 6–9).

(b) placing the base member 28 across the registry 8 at the intersection line 35 of the normalizing and transverse planes 23, 36 (FIG. 15), in disconnectable end contact with the notch segments 21, 22 (FIGS. 1–3), (c) dividing any leverage moment applied at the crown 11 of the shackle 12, about the normalizing plane 23 into the pairs of side wall shoulder surfaces 25, 26, 37, 38 (FIGS. 1–3 and 16) whereby irrespective of the direction of such leverage moment, at least half of each pair of shoulder surfaces 25, 26, 37, 38 is placed in compression. Since the prying force is working against itself, the padlock of the invention is substantially strengthened.

FIG. 16 illustrates step (c) in more detail wherein there is a full description of the contact area between pairs of side wall shoulder surfaces 25, 26, and 37, 38 of legs 18, 19 and end regions 29, 30 of base member 28.

It is assumed that the prying leverage is applied in the manner of FIGS. 1–3, by means of pry bar 5 and moments in the direction of arrows 7 and 10, are generated. Also, assume that shoulder surfaces 25, 26 are engaged with end region 29 while shoulder surfaces 37, 38 connect to end region 30.

As shown, shoulder surfaces 37, 38 in contact with end region 30 define a pair of horseshoe shaped contact areas 80, 81 while shoulder surfaces 25, 26 in contact with end region 29 define a pair of tear-drop shaped contact areas 82,83. Assuming a normalizing plane 23 is formed as shown, the contact areas 80–83 can be bisected into subregions 80*a*, 80*b*, 81*a*, 81*b*, 82*a*, 82*b*, 83*a* and 83*a*. Moreover, with the pry bar 5 in the portion shown in FIG. 16, subregions 80*b*, 81*a*, 82*b* and 83*a* are placed in compression.

ALTERNATE EMBODIMENTS

In the embodiment of FIGS. 1–16, the base member 28 is provided with a guide pin 34 that extends from exterior of the padlock 2 into its interior and prevents the base member 28 from following the shackle 12 in pivotal movement as previously explained. In the alternate embodiments detailed below, the guide pin 34 has been omitted. Hence, such alternate arrangements are especially useful in association with double-keeper padlocks.

In FIGS. 17 and 18, base member 28' is provided with a pair of guide struts 90, 91 in slidable contact with opposed front and rear walls 41, 42. In that way, since the struts 90, 91 are longer than the total initial rectilinear movement of the shackle in the direction of arrow 33, so as the shackle pivots, the base member 28 remains coextensive of the upper registry 8.

FIGS. 19, 20, and 21 illustrate a third embodiment for the same purpose in which base member 28'' includes slot 95 in end region 30'' modified to receive a wedge 96 that encircles and fully captures the longer leg 18 of the shackle 12. In order to attach the wedge 96 relative to the base member 28 after the long leg 18 has been captured, rivets 97 are affixed relative to openings 98 (FIG. 21). In order that the base member 28'' remains coextensive of the registry 8 of the padlock 2, a user's finger 99 shown in phantom line (FIG. 19), can be used to restrain the base member 28 from pivotal movement.

FIGS. 22 and 23 describe yet another embodiment for the same purpose in which base member 28'' includes a partial skirt 100 at front and rear walls 41, 42. Due to the rectangular cross section of the padlock 2, the partial skirt 100 extends along more than 60 percent of the perimeter. The height of the partial skirt 100 is about equal to that of the struts 90, 91 of FIGS. 17 and 18 and thus achieves a similar effect on padlock operations.

FIGS. 24, 25, and 26 illustrate yet another embodiment in which the partial skirt 100 of FIGS. 22 and 23 is extended about the side walls 43, 44 of the padlock 2 to provide full perimeter protection via full skirt 101. In order to allow the full skirt 101 to be attached relative to legs 18, 19, an end piece 103 is mounted by rivets 104 as shown. In the last two mentioned embodiments shown in FIGS. 22–26, such skirts 100, 101 not only prevent rotation of the base member 28, but also prevent insertion of a thin pry bar at the upper registry 8.

It should be understood that various modifications of the scope of this invention can be made by one of ordinary skill in the art without departing from the spirit thereof. I therefore wish my invention to be defined by the scope of the appended claims as the prior art will permit and in view of the specification if need be.

I claim:

1. An anti-pry anchor assembly for use with a shackle-type padlock having a planar disposed top wall registry through which a shackle passes and disconnectably connects with internal mechanisms in locking and unlocking positions, said shackle defining a U-shaped working area coincident with a normalizing plane through long and short legs of the shackle when the shackle is in the locked position relative to the top wall registry, said unlocking position occurring when at least one of the legs is displaced relative to said registry wherein at least the short leg is swingable about a pivot axis coincident with an axis of symmetry of the longer leg, comprising:

(a) reduced side wall notch segments disposed along the long and short legs of the shackle positioned exterior of said top wall registry in both locked and unlocked positions, each notch segment being bisected by said normalizing plane when said shackle is in the locked position, said each notch segment defining a pair of shoulder surfaces and a wall extending between said pairs of surfaces, (b) a planar base member substantially coextensive with said top wall registry, said base member including first and second integrally connected end regions each of which include surfaces engageable with one of the side wall notch segments, so that irrespective of the direction of application of prying moments at the shackle crown, at least half of each pair of shoulder surfaces is placed in compression thereby and the associated pry force works against itself and tends to prevent premature release of said shackle from said padlock.

2. The anchor assembly of claim 1 in which each pair of shoulder surfaces is also bisected by said normalizing plane.

3. The anchor assembly of claim 2 in which the contact area between the first end region of the base member and the pair of corresponding shoulder surfaces of said shackle is each in accordance with $$Ro^2 \cos^{-1} (Ro - h)/Ro - (Ro - h) \sqrt{2Roh - h^2}$$

where:

Ro is the radius of the shackle;

h is the rise distance of the pair of corresponding shoulder surfaces equal to Ro−Rocos $\theta/2$;

$\theta$ is the central angle subtended by the length of each of the pair of shoulder surfaces.

4. The anchor assembly of claim 3 in which the contact area between the second end region of the base member and the pair of shoulder surfaces is each in accordance with $$\pi Ro2 - [\pi/4\, R_1^2 + R1Lo + Ro^2 \cos^{-1} Ro - (Ro - h/Ro) - (Ro - h)\sqrt{2Roh - h1^2}\,]$$

where

Ro is the radius of the shackle;

R1 is the radius of a reduced hub of the shackle;

Lo is the longitudinal length of a slot in the second end regions of the base member measured from the center of radius Ro and R1 transverse to the slot;

h is the rise distance of the subtended sector beyond the normal to the intersecting edge equal to Ro−Ro cos $\theta_o/2$; and

$\theta$o is the central angle at the center of Ro and $R_1$ subtending a normal through the circumferential intersecting edge of each pair of shoulder surfaces and said slot.

5. The anchor assembly of claim 1 in which the planar base member includes guide pin means extending from exterior of the top wall registry into the interior of the padlock casing through an opening in said upper registry, so as to permit normal release of said shackle from locked to unlocked positions but prevents said base member from following the shackle in pivotal movement.

6. The anchor assembly of claim 1 in which said base member is provided with a pair of guide struts in slidable contact with opposed broad surfaces of said padlock so as to permit normal release of said shackle from locked to unlocked positions but prevents said base member from following said shackle in pivotal movement.

7. The anchor assembly of claim 6 in which said pair of guide struts of said base member extend along said opposed broad surfaces of front and back walls of said padlock to form a partial skirt that also prevents insertion of a thin pry bar in the plane of said top wall registry of said padlock.

8. The anchor assembly of claim 6 in which said base member is provided with a full perimeter skirt in slidable contact with broad surfaces of front, rear, and side walls of said padlock that prevents insertion of a thin pry bar at the top wall registry of the padlock.

9. In a shackle-equipped padlock having a top wall registry through a shackle defines locking and unlocking positions of the padlock, said shackle including long and short legs integrally connected together by an arcuate crown, the improvement comprising:

(a) reduced side wall notch segments along said long and short legs of said shackle exterior of said top wall registry in both locked and unlocked positions, said each notch segment defining a pair of shoulder surface and a wall extending between said pair of surfaces, (b) a planar base member substantially coextensive of said top wall registry, said base member also including first and second integrally connected end regions each of which includes surfaces engageable with one of said side wall notch segments in said locked position, whereby irrespective of the direction of application of prying moments at said crown of the shackle, at least half of each pair of shoulder surfaces is placed in compression thereby and the associated pry force works against itself and tends to prevent premature release of said shackle from said padlock.

10. The improvement of claim 9 in which each pair of shoulder surfaces is bisected by a normalizing plane through a U-shaped working area of said shackle.

11. The improvement of claim 10 in which the contact area between said first end region of said base member and said pair of corresponding shoulder surfaces bisected by said normalizing plane, is each in accordance with $$Ro^2 \cos^{-1} (Ro - h)/Ro - (Ro - h)\sqrt{2Roh - h^2}$$

where

Ro is the radius of said shackle;

h is the rise distance of said pair of corresponding shoulder surfaces equal to Ro−Rocos $\theta/2$;

$\theta$ is the central angle subtended by the length of each of said pair of shoulder surfaces.

12. The improvement of claim 11 in which the contact area between said second end region of said second end region of said base member and said pair of shoulder surfaces bisected by said normalizing plane, is each in accordance with $$\pi Ro2 - [\pi/4\, R_1^2 + R1Lo + Ro^2 \cos^{-1} Ro - (Ro - h/Ro) - (Ro - h)\sqrt{2Roh - h^2}\,]$$

where

Ro is the radius of the shackle;

R1 is the radius of a reduced hub of said shackle;

Lo is the longitudinal length of a slot in said second end regions of said base member measured from the center of radius Ro and R1 transverse to said slot;

h is the rise distance of the subtended sector beyond said normal to said intersecting edge equal to Ro−Ro cos $\theta_o/2$; and

$\theta$o is the central angle at center of radius Ro and R1 that subtends the normal through the circumferential intersecting edge of each pair of shoulder surfaces and said slot.

13. The improvement of claim 9 in which said planar base member includes guide pin means extending from exterior of said top wall registry into the interior of said padlock casing through an opening in the upper registry, so as to permit normal release of said shackle from locked to unlocked positions but prevents said base member from following the shackle in pivotal movement.

14. The improvement of claim 9 in which said base member is provided with a pair of guide struts in slidable contact with opposed broad surfaces of said padlock so as to permit normal release of said shackle from locked to unlocked positions but prevents said base member from following said shackle in pivotal movement.

15. The improvement of claim 14 in which said pair of guide struts of said base member extend along said opposed broad surfaces of front and back walls of said padlock to form a partial skirt that also prevents insertion of a thin pry bar at the top wall registry of said padlock.

16. The improvement of claim 9 in which said base member is provided with a full perimeter skirt in slidable contact with broad surfaces of front, rear, and side walls of said padlock that also prevents insertion of a thin pry bar at the top wall registry of said padlock.

17. In a shackle-equipped padlock having a top wall registry through which a shackle passes and defines locked and unlocked positions for said padlock, said shackle including long and short legs integrally connected together by an arcuate crown, a method of substantially increasing the maximum leverage moments that can be withstood by the padlock irrespective of the application direction of such moments at the crown of the shackle, comprising the steps of:

(a) establishing at the intersection of a normalizing plane coextensive of a U-shaped working area of the padlock and a second plane transverse to said normalizing plane adjacent to the upper registry of the padlock, first and second reduced notch segments along said long and short legs, each segment defining a pair of side wall shoulder surfaces and a recessed wall extending therebetween, (b) placing a base member in slidable surface contact across the registry of the padlock in disconnectable end contact with said notch segments, (c) dividing any leverage moments applied at the crown of the shackle, into said pair of shoulder surfaces of the side wall notch segments whereby irrespective of the application direction of such leverage moments, at least half of each pair of shoulder surfaces is placed in compression so that the associated pry force works against itself and tends to prevent premature release of said shackle from said padlock.

18. The method of claim 17 in which step (c) of surface dividing leverage moments into each pair of shoulder surfaces is relative to said normalizing plane which defines said at least half of each pair of surfaces in compression.

19. The method of claim 18 in which surface division of step (c) is division into a contact area between said first end region of said base member and said pair of corresponding shoulder surfaces bisected by said normalizing plane, defined in accordance with $$Ro^2 \cos^{-1} (Ro - h)/Ro - (Ro - \mathrm{h}) \sqrt{2Roh - h^2}$$

where:

Ro is the radius of said shackle;

h is the rise distance of said pair of corresponding shoulder surfaces equal to Ro−Ro cos $\theta/2$; and $\theta$ is the central angle subtended by the length of each of said pair of shoulder surfaces.

20. The method of claim 18 in which the surface division of step (c), is into a contact area between said second end region of said base member and said pair of shoulder surfaces bisected by said normalizing plane, defined in accordance with $$\pi Ro2 - [\pi/4\, R_1^2 + R1Lo + Ro^2 \cos^{-1} Ro - (Ro - h/Ro) -$$

-continued $$(Ro - h) \sqrt{2Roh - h^2}]$$

where

Ro is the radius of the shackle;

R1 is the radius of a reduced hub of said shackle;

Lo is the longitudinal length of a slot in said second end regions of said base member measured from the center of radius Ro and R1 transverse to said slot;

h is the rise distance of the subtended sector beyond said normal to said intersecting edge equal to Ro−Rocos $\theta o/2$; and $\theta$ is the central angle at the center of $R_o$ and $R_1$ subtending a normal through the circumferential intersecting edge of each pair of shoulder surfaces and said slot.

21. The method of claim 17, which includes the additional steps of:

(d) vertically moving the base member away from such slidable contact in concert with vertical movement of the shackle when the padlock is unlocked while retaining the base member in coextensive position with respect to the upper surface and coextension position with respect to the upper surface and (e) permitting the short leg to pivot form contact with said base member while retaining surface contact with the long leg.

22. The method of claim 21 wherein the base member of step (d) is retained in coextensive position by guide pin means extending from exterior of the top wall registry into the interior of the padlock through an opening in the upper registry, whereby normal release of said shackle from locked to unlocked positions is permitted, but said base member is prevented from following the shackle in pivotal movement.

23. The method of claim 21 wherein the base member of step (d) is retained by means of a pair of guide struts in slidable contact with opposed broad surfaces of the padlock so as to permit normal release of said shackle from locking to unlocking positions but prevents said base member from following said shackle in pivotal movement.

24. The method of claim 23 wherein the pair of guide struts of the base member extend along the opposed surfaces of front and back walls of the padlock to form a partial skirt that prevents insertion of a thin pry bar at the top wall registry of the padlock.

25. The method of claim 23 in which the base member is provided with a full perimeter skirt in slidable contact with broad surfaces of front, rear, and side walls of the padlock that prevents insertion of a thin pry bar at the top wall registry of the padlock.

26. In a shackle-type padlock having a pair of legs disposed in a housing, a locking mechanism engaging at least one leg of said shackle interiorly of said housing, the improvement which comprises:

(a) an anti-pry member spanning said shackle legs exterior of said housing;

(b) said anti-pry member being adapted to permit locking and unlocking of said shackle, and pivotal motion of at least one leg of said shackle away from said housing; and (c) said anti-pry member being disposed in close association with the portion of said exterior of said housing between said shackle legs to resist insertion of a thin prying instrument between said anti-pry member and said top wall; and (d) said anti-pry member being engageable with both said shackle legs when said padlock is locked to transfer prying force of a pry bar inserted between legs of said shackle from between said shackle and said housing to between said shackle and said anti-pry member so that said pry bar prying force works against itself instead of against said lock housing thereby tending to prevent premature release of said shackle from said lock by said prying force.

* * * * *

UNITED STATES PATENT AND TRADEMARK OFFICE

CERTIFICATE OF CORRECTION

PATENT NO. : 4,829,795

DATED : May 16, 1989

INVENTOR(S) : Jewell Taylor

It is certified that error appears in the above-identified patent and that said Letters Patent is hereby corrected as shown below:

Column 3, line 58, "FIG. is" should be ---FIG. 19 is---.

Column 5, line 13, "ar" should be ---are---.

Column 7, line 45, "$\pi Ro^2 - R_1{}^2$" should be ---$\pi Ro^2 - \pi R_1{}^2$---.

Column 8, line 34, "C Radius" should be ---radius---.

Column 8, lines 42-43, "77,72" should be ---17,72---.

Column 11, line 11, "$\pi Ro2$" should be ---$\pi Ro^2$---.

Column 11, line 13, "$\sqrt{2Roh-h1}^2$" should be ---$\sqrt{2Roh-h}^2$---.

Column 12, line 34, "$\pi Ro2$" should be ---$\pi Ro^2$---.

Column 13, line 67, "$\pi Ro2$" should be ---$\pi Ro^2$---.

Column 14, line 14, "$\theta$" should be ---$\theta o$---.

Signed and Sealed this

Seventeenth Day of April, 1990

*Attest:*

HARRY F. MANBECK, JR.

*Attesting Officer*

*Commissioner of Patents and Trademarks*